United States Patent [19]

Reiss

[11] 4,120,606

[45] Oct. 17, 1978

[54] SUBMERSIBLE MOTOR PUMP

[75] Inventor: Karl Reiss, Limbach, Fed. Rep. of Germany

[73] Assignee: Klein, Schanzlin & Becker Aktiengesellschaft, Fed. Rep. of Germany

[21] Appl. No.: 731,335

[22] Filed: Oct. 12, 1976

[30] Foreign Application Priority Data

Oct. 30, 1975 [DE] Fed. Rep. of Germany ..... 2548584

[51] Int. Cl.[2] ..... F04D 29/44

[52] U.S. Cl. ..... 415/199.1; 415/214; 415/501; 29/446; 29/511

[58] Field of Search ..... 415/214, 501, DIG. 3, 415/199.1, 199.3, 199.5, 200, 219 C, 128, 199.2; 29/446, 511, 156.4 R, 156.8 R; 417/424, 423 R, 360

[56] References Cited

U.S. PATENT DOCUMENTS

| | | | |
|---|---|---|---|
| 2,395,704 | 2/1946 | Wislicenus | 415/198.1 |
| 3,070,026 | 12/1962 | Lung | 415/501 |
| 3,116,696 | 1/1964 | Deters | 415/199.3 |
| 3,238,879 | 3/1966 | Shallenberg | 415/199.2 |
| 3,265,001 | 8/1966 | Deters | 415/501 |
| 3,437,045 | 4/1969 | Tremain | 415/199.2 |
| 3,438,329 | 4/1969 | Fuller | 415/199.3 |
| 3,521,970 | 7/1970 | Deters | 415/501 |
| 3,612,716 | 10/1971 | Deters | 415/501 |
| 3,676,013 | 7/1972 | Albertson | 415/501 |
| 3,730,641 | 5/1973 | Gordon | 415/214 |

FOREIGN PATENT DOCUMENTS

| | | | |
|---|---|---|---|
| 607,516 | 10/1960 | Canada | 417/424 |
| 807,812 | 1/1937 | France | 29/156.4 R |
| 893,509 | 4/1962 | United Kingdom | 415/199.3 |
| 1,189,198 | 4/1970 | United Kingdom | 415/501 |

*Primary Examiner*—C. J. Husar

*Attorney, Agent, or Firm*—Peter K. Kontler

[57] ABSTRACT

A submersible motor pump wherein the upper and lower end portions of the cylindrical pump housing are permanently secured to the discharge head and suction manifold, respectively, and subject the stacked deformable casings of pump stages in the housing to axial stresses so that the casings bulge radially outwardly and bear against the housing. The lower end portion of the housing is welded to or rolled into a circumferential groove of the suction manifold. The upper end portion of the housing is welded to the discharge head, rolled into a circumferential groove of the discharge head or upset to overlie a shoulder of the discharge head.

9 Claims, 3 Drawing Figures

SUBMERSIBLE MOTOR PUMP

BACKGROUND OF THE INVENTION

The present invention relates to single-stage or multi-stage centrifugal pumps in general, and more particularly to improvements in sump pumps or submersible motor pumps. For the sake of simplicity, the pump of the present invention will be referred to as a submersible motor pump with the understanding, however, that it can be used with equal advantage as a sump pump.

A submersible motor pump comprises an electric motor which is located at one end of an elongated tubular pump housing and a discharge head which is located at the other end of the housing and admits the fluid medium into a main, i.e., into a rising main if the apparatus is installed in a vertical pipe which contains the fluid medium to be pumped. The apparatus usually need not have a suction pipe because the medium to be pumped enters the first or the only stage of the pump by way of one or more strainers.

As a rule, a submersible motor pump comprises several stages whose components consist of metallic or synthetic plastic material. Such types of apparatus are often used to evacuate liquid (e.g., water) from deep walls. In most instances, the motor is mounted below the pump so that the liquid to be pumped can flow around the motor and cools the latter before it enters the first or lowermost pump stage.

U.S. Pat. No. 3,521,970 to Deters discloses a submersible motor pump wherein the cylindrical pump housing comprises internally threaded upper and lower end portions. The internal threads of the lower end portion mate with external threads of a suction manifold, and the internal threads of the upper end portion mate with the external threads of a complex discharge head. The pump shaft is attached to the output shaft of the motor by a specially designed coupling. The pump shaft is guided by the suction manifold and is mounted in suitable bearings. A drawback of the patented apparatus is that the cost of machining threads into the pump housing as well as into the suction manifold and discharge head is very high. Moreover, the machining of bearings for the pump shaft is costly and the component parts of the pump stages must be machined or otherwise produced with a very high degree of precision. Still further, the pump shaft must be accurately centered in the stages and in the suction manifold in order to prevent wobbling of impellers when the apparatus is in use.

OBJECTS AND SUMMARY OF THE INVENTION

An object of the invention is to provide a novel and improved submersible motor pump wherein the component parts, especially the parts of the pump, need not be machined or otherwise produced with a high degree of precision but the pump shaft and the impellers of the pump stages can nevertheless rotate without any wobbling or other stray movements.

Another object of the invention is to provide a submersible motor pump whose initial and/or maintenance cost is a small fraction of the cost of heretofore known apparatus of the same character, and which can be used in vertical position or any other desired orientation.

A further object of the invention is to provide novel and improved connections between the end portions of the pump housing in a submersible motor pump and the neighboring components of the apparatus.

An additional object of the invention is to provide a submersible motor pump which can be readily dismantled to afford access to the interior of the pump housing in spite of the fact that the latter does not have internal and/or external threads or analogous complex and expensive readily separable coupling or connecting means.

An ancillary object of the invention is to provide the submersible motor pump with novel and improved means for holding the casing or casings of the pump stage(s) against rotation with the pump shaft and to provide novel and improved means for centering the pump shaft.

The invention is embodied in a submersible motor pump which comprises a tubular pump housing having a first and a second end portion, fluid conveying means including at least one pump stage in the housing, such stage having a casing including a tubular outer portion which is adjacent to the internal surface of the housing, first and second compressing members which respectively extend into the first and second end portions of the housing (one of the compressing members may constitute a suction manifold which admits liquid into the nearest stage of the pump and the other compressing member may constitute a discharge head which admits pumped fluid into a rising main), and first and second connecting means for permanently securing the first and second compressing members to the respective end portions of the housing at such a distance from each other that the casing is subjected to axial stresses which suffice to prevent rotation of the casing relative to the housing. The casing preferably consists of a deformable elastomeric material and its tubular outer portion bulges radially outwardly in response to axial stresses so that such tubular portion is maintained in strong frictional engagement with the housing.

Each connecting means may include a welded connection between the respective compressing member and the adjacent end portion of the housing. Alternatively, at least one of the connecting means may comprise a groove or recess which is machined into the periphery of the respective compressing member and a projection which forms part of the corresponding end portion and extends into the recess. Such projection can be formed by rolling the material of the respective end portion into the groove. Still further, at least one of the connecting means may include a shoulder on the respective compressing member and a bent-over (upset) part of the corresponding end portion which overlies the shoulder.

The connecting means establish permanent connections between the compressing members and the respective end portions of the housing, i.e., such connections cannot be established or terminated without at least some deformation of or removal of material from the end portion and/or the associated compressing member.

The novel features which are considered as characteristic of the invention are set forth in particular in the appended claims. The improved submersible motor pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
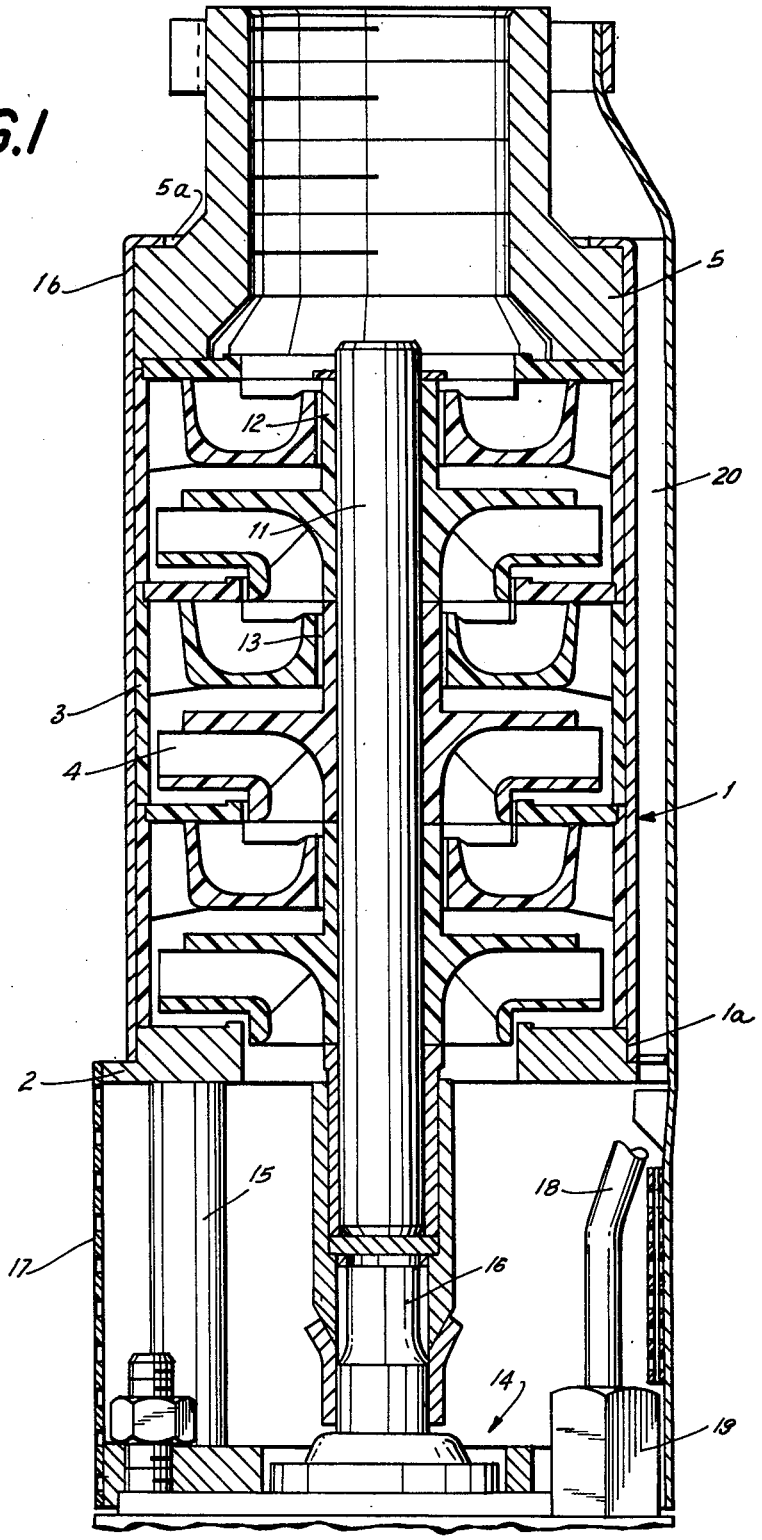
FIG. 1 is an axial sectional view of the pump in a submersible motor pump which embodies one form of the invention.

FIG. 1 shows the pump and a portion of the motor 14 in a submersible motor pump. The motor 14 is disposed below the cylindrical pump housing or body 1 and is secured to a suction manifold 2 of the pump by one or more tie rods 15 or analogous connectors. The output shaft 16 of the motor 14 is a stub which transmits torque to the pump shaft 11. The pump further comprises several coaxial stages each of which includes an impeller 4 and a casing 3 having a tubular outer portion which is adjacent to the internal surface of the housing 1. The intake strainer which admits liquid to the lowermost stage via suction manifold 2 is shown at 17. A discharge head 5 above the uppermost stage of the pump admits liquid into a rising main, not shown.

In the embodiment of FIG. 1, the lower end portion 1*a* of the pump housing 1 is welded to a smaller-diameter portion of the suction manifold 2, and the upper end portion 1*b* of the housing 1 is deformed or upset so that it overlies an annular shoulder 5*a* of the discharge head 5. The casings 3 consist of an elastically or permanently deformable material, preferably an elastomeric synthetic plastic material, and are biased axially by the discharge head 5 and suction manifold 2 so that their tubular outer portions bulge radially outwardly and bear against the internal surface of the housing 1. This suffices to insure that the casings 3 cannot rotate in response to rotation of the pump shaft 11. The outer diameters of the casings 3, in undeformed condition of the casings, are selected in such a way that the casings can be inserted into the housing 1 with at least some radial clearance prior to insertion of the head 5 and subsequent deformation or upsetting of the upper end portion 1*b* so that the end portion 1*b* overlies the shoulder 5*a*. Such mode of assembling the pump is simple, time-saving and eliminates the need for a host of washers, gaskets, packings and analogous sealing elements. Moreover, the insertion of the discharge head 5 at such a distance from the suction manifold 2 that the casings 3 undergo axial compression with resultant radial expansion of their tubular outer portions into frictional engagement with the internal surface of the pump housing 1 insures an automatic centering of the casings in the interior of the pump housing.

If it becomes necessary to gain access to the interior of the pump, the deformed part of the upper end portion 1*b* of the housing 1 is converted into a cylinder so as to allow for extraction of the discharge head 5. This affords access to component parts of the stages. The means for terminating the connection between the deformed part of the end portion 1*b* and the shoulder 5*a* may constitute any suitable tool, not shown. The material of the cylindrical housing 1 (or at least of the upper end portion 1*b*) is preferably selected in such a way that it can undergo repeated deformation; this insures that the discharge head 5 can be reinserted upon completion of inspection of the interior of the pump before the upper part of the end portion 1*b* is deformed again so that it overlies the shoulder 5*a* and maintains the head 5 at a desired distance from the suction manifold 2, i.e., at a distance which is sufficiently small to insure sufficient radial expansion of the casings 3 into strong frictional engagement with the internal surface of the housing 1. Renewed deformation of the upper part of the end portion 1*b* can be readily carried out in such a way that the overall length of the submersible motor pump remains unchanged.

The pump shaft 11 may consist of suitably profiled steel and extends upwardly beyond the hub or nave 12 of the uppermost impeller 4. The reference character 13 denotes the hub of one of the casings 3; such hubs serve as bearings for the pump shaft 11. Additional bearings for the pump shaft 11 are not needed. Thus, one can dispense with the customary radial bearings for the pump shaft because the pump shaft is automatically centered due to the well known Lomakin effect.

The reference character 18 denotes a cable which is led out of the motor 14 via cable gland 19 and extends upwardly through a channel 20 at the outer side of the housing 1.

Figure 2:
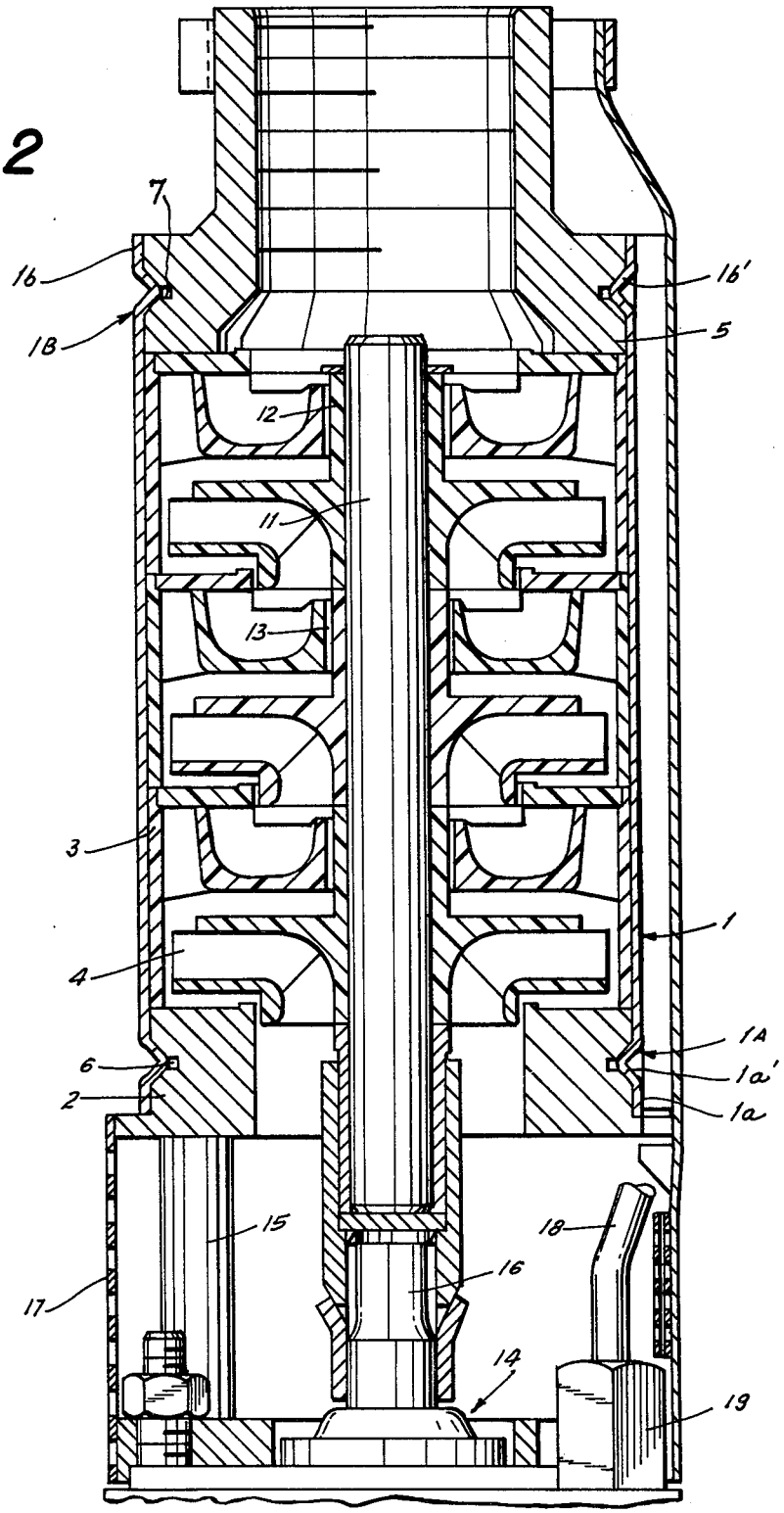
FIG. 2 is an axial sectional view of a pump which forms part of a modified submersible motor pump.

FIG. 2 shows the pump of a second submersible motor pump. All such parts of the structure shown in FIG. 2 which are identical with or clearly analogous to corresponding parts of the first apparatus are denoted by similar reference characters. The discharge head 5 has a circumferential groove or recess 7 and the upper end portion 1*b* of the housing 1 is deformed to form an inwardly extending annular projection or rib 1*b'* which extends into the groove 7. This establishes a permanent connection between the parts 1*b* and 5. A similar permanent connection is established between the lower end portion 1*a* of the housing 1 and the suction manifold 2. The latter has a circumferential groove or recess 6 for the inwardly extending annular projection or rib 1*a'* of the end portion 1*a*. The ribs 1*a'*, 1*b'* may be formed by resorting to a suitable rolling procedure.

If it should become necessary to gain access to the interior of the housing 1 of the pump shown in FIG. 2, the upper end portion 1*b* can be severed at the locus 1B so that the head 5 can be lifted above and away from the uppermost stage. Once the head 5 is reinserted into the thus shortened end portion 1*b*, the latter is simply welded to the lower portion of the head 5. The permanent connection between the suction manifold 2 and the lower end portion 1*a* can be destroyed in an analogous manner, i.e., the end portion 1*a* can be severed at the locus 1A and the remnant of the end portion 1*a* can be welded to the uppermost part of the manifold 2 subsequent to renewed assembly of the pump. Alternatively, the connection between the head 5 and the shortened upper end portion 1*b* can be reestablished by machining a second groove into the lower part of the head 5 and by thereupon deforming the remnant of the end portion 1*b* so that it extends into the second groove. The same applies for establishment of renewed connection between the suction manifold 2 and the remnant of the lower end portion 1*a*.

The ribs or projections 1*a'*, 1*b'* can be welded to the respective compressing members 2 and 5 to establish a second bond between the housing 1 and such members. Alternatively, the rib 1*b'* can be welded to the head 5 before the end portion 1*b* is severed at 1B to allow for lifting of the head 5 above the uppermost pump stage. The same applies for the lower end portion 1*a* and the suction manifold 2.

Figure 3:
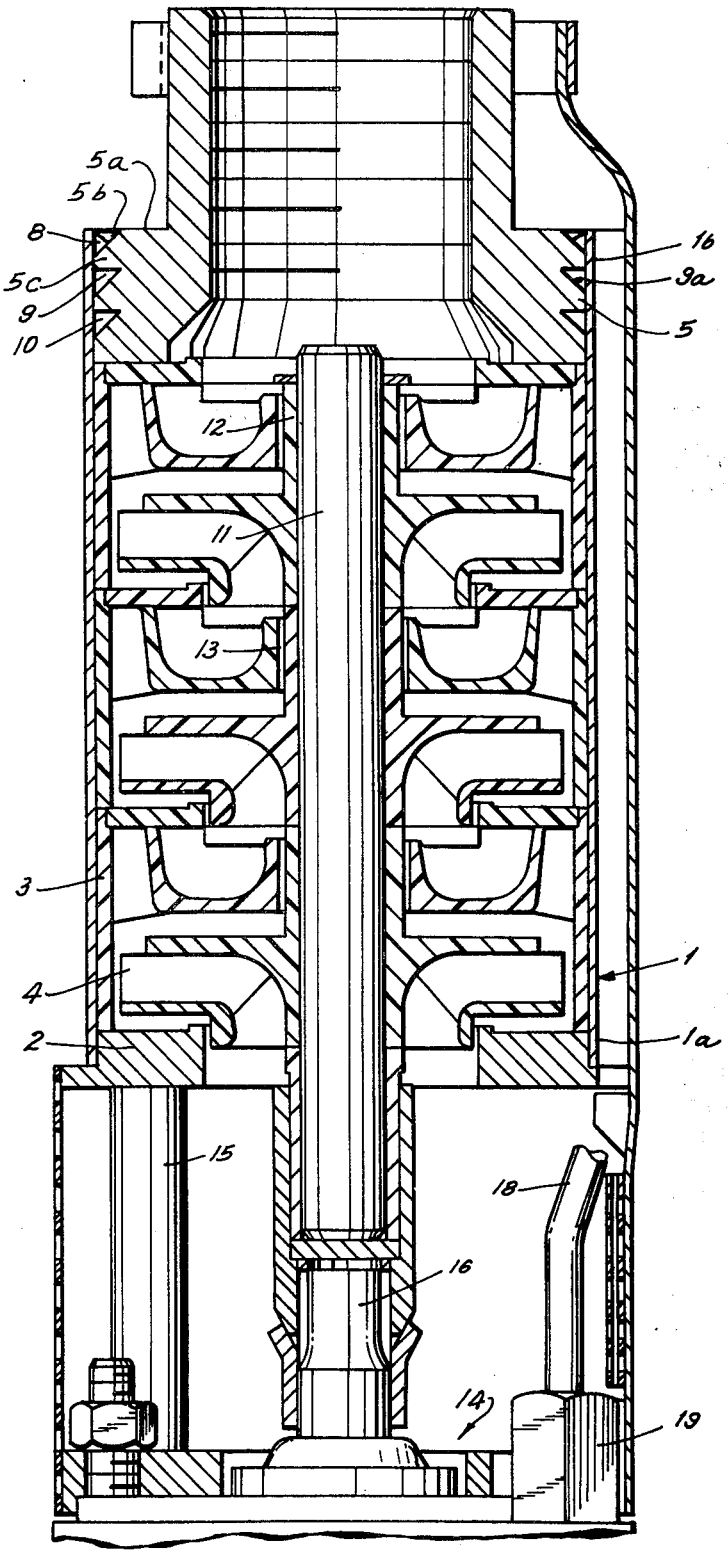
FIG. 3 is an axial sectional view of the pump in a third submersible motor pump.

FIG. 3 shows the pump of a third submersible motor pump wherein the discharge head 5 has one or more circumferential grooves (two shown at 9 and 10) and a chamfer 5*b* which surrounds the shoulder 5*a*. The uppermost part of the upper end portion 1*b* of the housing 1 is permanently bonded to the head 5 by a seam 8 of weldant. The lower end portion 1*a* is welded to the smaller-diameter upper portion of the suction manifold 2, the same as in the embodiment of FIG. 1.

If it becomes necessary to gain access to the interior of the pump housing 1, the person in charge destroys the seam 8, e.g., by resorting to a suitable material removing tool. The discharge head 5 is then lifted above and away from the uppermost stage of the pump. The attendant may also remove the circumferential ring-shaped portion 5*c* between the shoulder 5*a* and the groove 9 so that, when the discharge head 5 is reinserted into the upper end portion 1*b*, the latter can be welded to the head 5 by a seam which bonds it to the sloping surface 9*a* in the groove 9. A renewed dismantling of the pump can be followed by bonding the end portion 1*b* to the head 5 in the region of the lowermost groove 10. It is clear that the housing 1 can be permanently connected with the compressing members 2 and 5 in a number of other ways without departing from the spirit of the invention. For example, the lower end portion 1*a* can be permanently secured to the suction manifold 2 in a manner as shown in FIG. 2, and the upper end portion 1*b* can be secured to the discharge head 5 in a manner as shown in FIG. 1 or 3. In other words, the features of FIGS. 1, 2 and 3 can be used interchangeably and in any desired combination. The number of stages can be reduced to two or one, or increased beyond the number which is shown in the drawing.

It is further within the purview of the invention to install the motor 14 above the pump housing 1 or to use the improved motor pump in horizontal position, e.g., in a liquid pressurizing or analogous plant. Furthermore, the improved apparatus can be used as a sump pump, i.e., it can be installed in such a way that only the pump housing 1 and its strainer or strainers 17 are submerged in the medium to be pumped.

All those part of the apparatus which come into contact with the medium to be pumped can be made of or coated with a corrosion-resistant material.

An important advantage of the improved apparatus is that it can be assembled within a very short interval of time. Furthermore, the apparatus is simple, rugged and inexpensive because its parts need not be provided with internal and/or external threads, and the seals are eliminated altogether or their number is reduced to a fraction of the number of seals used in heretofore known submersible and analogous motor pumps. The same applies for the bearings for the pump and/or motor shaft. Still further, the component parts of the pump, especially the components of the stage or stages, can be machined or otherwise produced with large tolerances because the deformability of such parts in response to axial stressing between the compressing members 2 and 5 allows for proper centering of such deformable parts as well as of the pump shaft. Since the casings 3 are held against rotation solely as a result of friction between their external surfaces and the internal surface of the housing 1, the apparatus need not be provided with additional parts for holding the casings against angular movement with the pump shaft 11. This also contributes to lower cost and simplicity of the apparatus. The component parts of the stage or stages can be readily inserted into or removed from the housing 1 because their inner diameters can greatly exceed the diameter of the pump shaft 11 and their outer diameters can be much smaller than the inner diameter of the casing 1 when the parts of the stage or stages are not subjected to axial stresses which cause the tubular outer portions of the casings 3 to bulge radially outwardly and the hubs 12, 13 to center the pump shaft.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a submersible motor pump, a combination comprising a tubular pump housing having first and second end portions; fluid conveying means including at least one stage in said housing, said stage having a casing; first and second compressing members respectively extending into said first and second end portions; and first and second connecting means for permanently securing said first and second compressing members to the respective end portions at such a distance from each other that said casing is subjected to axial stresses, said casing consisting of deformable material and bearing against the internal surface of said housing as a result of said axial stresses with a force which suffices to invariably prevent any movements of said casing relative to said housing.

2. A combination as defined in claim 1, wherein said fluid conveying means comprises a plurality of stages and the casings of said stages are disposed end-to-end in the interior of said housing between said end portions.

3. A combination as defined in claim 1, wherein at least one of said connecting means constitutes a welded connection between the corresponding compressing member and end portion.

4. A combination as defined in claim 1, wherein at least one of said connecting means includes a groove provided in the periphery of the corresponding compressing member and a projection forming part of the respective end portion and extending into said groove.

5. A combination as defined in claim 1, wherein at least one of said connecting means comprises a shoulder on the respective compressing member and a bent-over part of the corresponding end portion, said bent-over part overlying said shoulder.

6. A combination as defined in claim 1, wherein one of said compressing members is the suction manifold of said motor pump.

7. A combination as defined in claim 1, wherein one of said compressing members is the discharge head of said motor pump.

8. A combination as defined in claim 1, wherein said casing consists of elastomeric synthetic plastic material and includes a tubular portion adjacent to and bearing against the internal surface of said housing as a result of said axial stresses.

9. A combination as defined in claim 8, wherein said casing further includes a tubular hub and said stage further comprises a rotary impeller in said casing, and further comprising a rotary pump shaft extending through and centered by said hub and arranged to rotate said impeller.

* * * * *